US010166653B2

(12) United States Patent
Lee et al.

(10) Patent No.: US 10,166,653 B2
(45) Date of Patent: Jan. 1, 2019

(54) CMP PAD CONDITIONER

(75) Inventors: Seh Kwang Lee, Gyeonggi-do (KR); Joo Han Lee, Gyeonggi-do (KR)

(73) Assignee: EHWA DIAMOND INDUSTRIAL CO., LTD., Gyeonggi-Do (KR)

( * ) Notice: Subject to any disclaimer, the term of this patent is extended or adjusted under 35 U.S.C. 154(b) by 825 days.

(21) Appl. No.: 14/233,489

(22) PCT Filed: Jul. 16, 2012

(86) PCT No.: PCT/KR2012/005649
§ 371 (c)(1),
(2), (4) Date: Jan. 17, 2014

(87) PCT Pub. No.: WO2013/012226
PCT Pub. Date: Jan. 24, 2013

(65) Prior Publication Data

US 2014/0154960 A1 Jun. 5, 2014

(30) Foreign Application Priority Data

Jul. 18, 2011 (KR) ..... 10-2011-0070924
Jun. 21, 2012 (KR) ..... 10-2012-0066596

(51) Int. Cl.
*B24B 53/017* (2012.01)
*B24B 53/12* (2006.01)

(52) U.S. Cl.
CPC ..... *B24B 53/017* (2013.01); *B24B 53/12* (2013.01)

(58) Field of Classification Search
CPC ..... B24B 53/017; B24B 53/12
See application file for complete search history.

(56) References Cited

U.S. PATENT DOCUMENTS

| | | | | |
|---|---|---|---|---|
| 9,132,526 | B2 * | 9/2015 | Smith | B24B 53/017 |
| 2008/0153398 | A1 * | 6/2008 | Sung | 451/56 |
| 2009/0068937 | A1 * | 3/2009 | Sung | B24B 53/017 451/444 |
| 2011/0250826 | A1 * | 10/2011 | Yoon et al. | 451/443 |
| 2014/0113532 | A1 * | 4/2014 | Smith et al. | 451/443 |

FOREIGN PATENT DOCUMENTS

| | | | |
|---|---|---|---|
| DE | 10085092 | T1 | 11/2002 |
| JP | 2003-175465 | A | 6/2003 |
| JP | 2004-537646 | A | 12/2004 |
| JP | 2010-069612 | A | 4/2010 |
| JP | 2010-125587 | A | 6/2010 |
| KR | 10-2000-0024453 | A | 5/2000 |

(Continued)

OTHER PUBLICATIONS

International Search Report for PCT/KR2012/005649.

(Continued)

*Primary Examiner* — Timothy V Eley
(74) *Attorney, Agent, or Firm* — The PL Law Group, PLLC

(57) ABSTRACT

The present invention relates to a CMP pad conditioner having a substrate and a cutting tip pattern formed on at least one surface of the substrate, and more particularly to a CMP pad conditioner having cutting tip patterns, in which the cutting tip patterns have an improved structure that can increase the productivity of the CMP pad conditioner and that can sufficiently ensure the strength and safety of the cutting tip patterns.

18 Claims, 6 Drawing Sheets

(56) References Cited

FOREIGN PATENT DOCUMENTS

| | | | |
|---|---|---|---|
| KR | 10-2006-0085338 | A | 7/2006 |
| KR | 10-2010-0033911 | A | 3/2010 |
| KR | 10-2010-0110989 | A | 10/2010 |
| KR | 10-2011-0060045 | A | 6/2011 |
| TW | 200726582 | A | 7/2007 |
| TW | 200841996 | A | 11/2008 |

OTHER PUBLICATIONS

Office action dated Aug. 26, 2013 from Korean Intellectual Property Office in a counterpart Korean Patent Application 10-2012-0066596.
Office action dated Aug. 26, 2013 from Korean Intellectual Property Office in a counterpart Korean Patent Application 10-2013-0128459.
Office action dated Jul. 14, 2014 from Taiwan Intellectual Property Office in a counterpart Taiwan Patent Application No. 101125747.
Office action dated Oct. 21, 2014 from Japanese Intellectual Property Office in a counterpart Japanese Patent No. 2014-521548.
Office action dated Nov. 4, 2013 from German Patent and Trademark Office in a counterpart Taiwan Patent Application No. TW 101125747.

* cited by examiner

Enlarged photograph of cutting tip pattern of sample 1

Enlarged photograph of cutting tip pattern of sample 2

CMP PAD CONDITIONER

CROSS REFERENCE TO RELATED APPLICATIONS AND CLAIM OF PRIORITY

This patent application is a National Phase application under 35 U.S.C. § 371 of International Application No. PCT/KR2012/005649, filed 16 Jul. 2012, which claims priority to Korean Patent Application numbers 10-2011-0070924, filed 18 Jul. 2011, and 10-2012-0066596, filed 21 Jun. 2012, entire contents of which are incorporated herein by reference.

BACKGROUND

1. Field of the Invention

The present invention relates to a chemical mechanical polishing (CMP) pad conditioner having a substrate and a cutting tip pattern formed on at least one surface of the substrate.

2. Description of the Related Art

Currently, the speed and integration density of semiconductor circuits are increasing, and thus the size of semiconductor chips is gradually increasing. In addition, in order to provide multilayer interconnection structures, the width of interconnections is being minimized and the diameter of the wafers is becoming larger.

However, with an increase in the integration density of devices and a decrease in the minimum line width, limitations that cannot be overcome by partial planarization, according to the related art, have arisen. To enhance processing efficiency or quality, global planarization of wafers is performed by CMP. Global planarization by CMP is a necessary part of current wafer processes.

CMP is a polishing process in which a semiconductor wafer is planarized by chemical and mechanical treatment.

In principle, CMP polishing is performed by pressing a polishing pad and a wafer against each other and moving them with respect to each other while supplying a slurry consisting of a mixture of abrasive particles and chemicals to the polishing pad. Herein, a large number of pores on the surface of the polishing pad, which is made of polyurethane, serve to receive fresh polishing solution so that high polishing efficiency and uniform polishing of the wafer surface can be obtained.

However, because different pressures and relative speeds are applied during the polishing process, the surface of the polishing pad can become non-uniformly deformed with the passage of time during the polishing, and the pores on the polishing pad can become clogged with the polishing residue, wherein the polishing pad cannot perform its intended function. For this reason, uniform polishing of the wafer surface by global planarization cannot be accomplished.

To overcome the non-uniform deformation of the CMP polishing pad and the clogging of the pores of the CMP polishing pad, a CMP pad-conditioning process is performed by finely polishing the surface of the polishing pad using a CMP pad conditioner so as to form new pores on the pad.

The CMP pad conditioning process can be performed at the same time as the CMP process to increase productivity. This is so-called "in-situ conditioning".

The polishing solution that is used in the CMP process contains abrasive particles, such as silica, alumina, or ceria, and the CMP processes are broadly classified into oxide CMP and metal CMP, according to the kind of polishing process used. The polishing solution that is used in oxide CMP generally has a pH of 10-12, and the polishing solution that is used in metal CMP has an acidic pH of 4 or less.

Conventional CMP pad conditioners include an electroplated-type CMP pad conditioner, manufactured by an electroplating process, and a melted-type CMP pad conditioner manufactured by melting a CMP pad conditioner and metal powder at high temperature.

However, these conventional electrodeposited-type and melted-type CMP pad conditioners have a problem in that, when they are used for in-situ conditioning in the metal CMP process, diamond particles attached to the surface of the CMP pad conditioners become detached from the surface via the action of polishing via the polishing particles of the CMP slurry and surface corrosion caused by the acidic solution.

When the detached diamond particles are stuck in the CMP polishing pad during the CMP polishing process, they scratch the water surface to increase process defect rates and make it necessary to replace the CMP polishing pad.

In addition, metal ions released from the metal binder via corrosion move to the metal line of a semiconductor circuit during the metal CMP process and can cause metal ion contamination, which causes short circuits. Because the short circuits caused by metal ion contamination are only revealed after all of the processes have been completed, the loss of production cost via the metal ion contamination is significant.

In an attempt to solve the above-described problems that occur in conventional CMP pad conditioners, Korean Patent Laid-Open Publication No. 2000-24453 discloses a polishing pad conditioner and a manufacturing method thereof. This patent publication discloses the processing of a substrate having a plurality of polygonal columns, which protrude from at least one surface thereof to substantially the same height, using a chemical vapor deposition (CVD) process, thereby forming a diamond thin film on the surface. Herein, the polygonal columns are the protruding cutting tips.

This polishing pad conditioner includes a plurality of cutting tips which protrude by substantially the same distance. These tips can produce minor cuts on a polyurethane polishing pad during a conditioning process, but cannot finely crush large debris generated during the conditioning process, nor efficiently sweep out the sludge that is generated from the wafer.

For such functions as these, the polishing pad conditioner should have, in addition to cutting tips for cutting the polishing pad, cutting tips that are of different heights, which reduce the size of debris generated during the conditioning process and make the flow of the sludge smoother.

FIG. 1 shows a conventional CMP pad conditioner 101 having cutting tips. As shown in FIG. 1, in order to form a plurality of independent cutting tip patterns 120 on a substrate 110, diamond is deposited on the substrate 110 and then patterned using an etching mask. Then, a diamond coating layer 130 is deposited on the cutting tip patterns 120.

However, this CMP pad conditioner has the following two problems. First, in order to form the cutting tip patterns on the substrate via the first diamond deposition process, a diamond layer should be formed on the substrate to a height corresponding to the height of the cutting tips.

Various processes are used to form a diamond deposition layer using a CVD process. Among them, a thermal filament process is generally used to form a substrate having a relatively large area, such as a CMP pad conditioner.

When the thermal filament process is used, a coating time of 100-200 hours is required to grow the diamond layer to a height of 30-60 μm, so as to form cutting tip patterns for a CMP pad conditioner, because the growth rate of diamond is as low as about 0.1-0.3 μm/hr. For this reason, the productivity of the CMP pad conditioner is significantly reduced.

Another problem is that diamonds have extremely low impact strength due to their high brittleness, even though diamonds have high hardness. Considering conditioner pressure and abrasion via friction with the polishing material, which occur via finely cutting the tip patterns during polishing of the polishing pad in the CMP system, the stability of the cutting patterns against breakage and detachment cannot be ensured. This breakage and detachment of the cutting tip patterns cause scratches to form on the silicon wafers.

Accordingly, it is important to ensure the impact stability of the cutting tip patterns. However, it is difficult to form fine cutting tip patterns having a size of 100 μm because CVD diamond layers grow into columnar structures that are very weak against the shear loads applied during the conditioning process.

SUMMARY

One embodiment of the present invention relates to a CMP pad conditioner having cutting tip patterns, which are formed quickly and easily so that the productivity of the CMP pad conditioner can be increased.

Another embodiment of the present invention relates to a CMP pad conditioner in which the cutting tip patterns have fine structures while the strength and stability thereof is ensured.

Still another embodiment of the present invention relates to a CMP pad conditioner having cutting tip patterns, which efficiently perform the removal of debris and the discharge of foreign matter, such as sludge, during a conditioning process.

Embodiments of the present invention are not limited to the above-mentioned embodiments, and other embodiments will be clear to those skilled in the art from the following description.

One embodiment of the present invention relates to a CMP pad conditioner having a substrate and cutting tip patterns formed on at least one surface of the substrate, wherein the cutting tip patterns include: a plurality of substrate tip portions formed and spaced apart from each other on the substrate; and diamond deposition tip portions formed on the plurality of substrate tip portions.

Herein, the plurality of substrate tip portions may be formed to have the same height, and the diamond deposition tip portions formed on the plurality of substrate tip portions may be formed to have the same thickness, so that cutting tips of the cutting tip patterns have the same height. However, in some cases, some of the plurality of substrate tip portions may be formed to have different heights, or some of the diamond tip portions may have different thicknesses, so that the cutting tips of the cutting tip patterns may have different heights. More particularly, if the cutting tips of the cutting tip patterns are to have different heights, the plurality of substrate tip portions may be formed to have different heights and the diamond deposition tip portions may be formed on the substrate tip portions to the same thickness.

Another aspect of the present invention relates to a CMP pad conditioner having a substrate and cutting tip patterns formed on at least one surface of the substrate, wherein the cutting tip patterns include: a plurality of substrate tip portions formed and spaced apart from each other on the substrate; and diamond deposition tip portions formed on some of the plurality of substrate tip portions.

The plurality of substrate tip portions are formed to have the same height, and the diamond deposition tip portions, having the same thickness, are formed on one substrate tip portion of adjacent substrate tip portions, and are also not formed on the other substrate tip portions, so that the cutting tips of the cutting tip patterns have different heights.

The substrate tip portions may be spaced apart from each other by depressions on the substrate.

Herein, the substrate tip portions may have a polygonal cross-sectional shape.

Moreover, the substrate tip portions may have a polygonal, circular, or elliptic planar shape.

Furthermore, the diamond deposition tip portions may have a thickness of 1-10 μm.

Herein, the upper surface of the cutting tip patterns is dressed with a wheel having a silicon carbide (SiC) abrasive material or a resin wheel having diamond grits.

In addition, the CMP pad conditioner further includes a diamond coating layer formed on both the substrate and the cutting tip patterns.

By virtue of this configuration, the cutting tip patterns may have a fine structure of 100 μm or less.

The present invention has the following excellent effects.

First, in the CMP pad conditioner of the present invention, the cutting tip patterns can be formed in a fast and easy manner so that the productivity of the CMP pad conditioner can be increased.

Also, in the CMP pad conditioner of the present invention, the cutting tip patterns formed may have a fine structures wherein the strength and stability thereof are ensured.

Lastly, in the CMP pad conditioner of the present invention, the cutting tip patterns efficiently remove debris and expel foreign matter, such as sludge, during a conditioning process.

DETAILED DESCRIPTION

Figure 1:
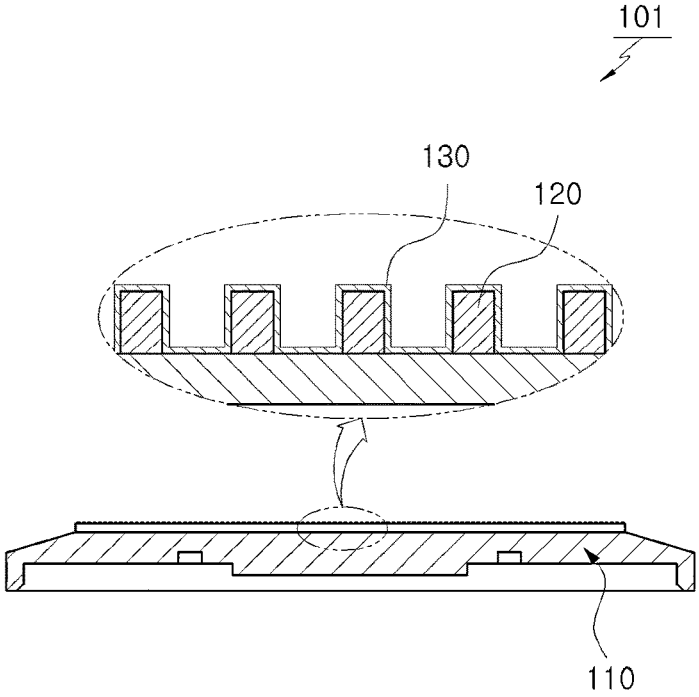
FIG. 1 is a cross-sectional view of a conventional CMP pad conditioner.

Hereinafter, the present invention will be described in detail with reference to the accompanying drawings.

FIGS. 2*a*, 2*b*, 3*a*, and 3*b* are cross-sectional views of CMP pad conditioners wherein all the cutting tips of cutting patterns include substrate tip portions and deposition tip portions. FIGS. 4*a*, 4*b*, 5*a*, and 5*b* are cross-sectional views of CMP pad conditioners wherein only some of the cutting tips of cutting patterns include substrate tip portions and diamond deposition tip portions. As shown in these figures, a CMP pad conditioner 1, according to the present invention, includes a substrate 10 and cutting tip patterns 20 formed on at least one surface of the substrate 10.

The substrate 10 may be made of a high-hardness material, such as a general iron alloy, a super-hard alloy, or a ceramic material, and may have a disc shape.

Herein, the material of the substrate 10 is preferably at least one selected from among SiC, silicon nitride ($Si_3N_4$), tungsten carbide (WC), and mixtures thereof without limitation.

In some cases, the substrate 10 may be made of one or more selected from among WC-based super-hard alloys, including tungsten carbide-cobalt (WC—Co), tungsten carbide-titanium carbide-cobalt (WC—TiC—Co), and tungsten carbide-titanium carbide-tantalum carbide-cobalt (WC—TiC—TaC—Co), as well as thermet (TiCN)—, boron carbide ($B_4C$)—, and titanium borate ($TiB_2$)-based super-hard alloys. In addition, the substrate may preferably be made of a ceramic material, such as silicon nitride ($Si_3N_4$), or silicon (Si). Other examples of the material of the substrate 10 include aluminum oxide ($Al_2O_3$), aluminum nitride (AlN), titanium oxide ($TiO_2$), zirconium oxide (ZrOx), silicon oxide ($SiO_2$), silicon carbide (SiC), silicon oxynitride (SiOxNy), tungsten nitride (WNx), tungsten oxide (WOx), diamond-like coating (DLC), boron nitride (BN), or chromium oxide ($Cr_2O_3$).

Furthermore, in one embodiment the substrate has a disc shape when viewed from the top, and in some cases, may have a polygonal shape.

In another embodiment, before the cutting tip patterns 20 are formed, at least one surface of the substrate 10 is planarized by grinding or lapping and is ultrasonically treated before deposition of the diamond deposition tip portions 23.

The cutting tip patterns 20 include a plurality of substrate tip portions 21 formed on one surface of the substrate 10, and diamond deposition tip portions 23 formed on some or all of the plurality of substrate tip portions 21.

The substrate tip portions 21 may be formed and spaced apart from each other on the substrate 10 with the same or different heights. As shown in FIGS. 2*a* through 4*b*, the substrate tip portions 21 may be portions having a rectangular cross-sectional shape, which are spaced apart from each other by depressions 25. Alternatively, as shown in FIGS. 5*a* and 5*b*, the substrate tip portions 21 may have a structure wherein the substrate tip portions 21, having a rectangular cross-sectional shape, and substrate tip portions 21*a*, having a triangular cross-sectional shape, are alternated with each other and spaced apart from each other by depressions 25. In addition, the substrate tip portions 21 may have a polygonal, circular, or oval shape when viewed from the top. Although not shown in the figures, it is be understood that the substrate tip portions 21 may have a polygonal horn shape, or a polygonal conical or elliptic conical shape, or a cylindrical or elliptic cylindrical shape, when viewed from the side and from the top.

The substrate tip portions 21 may be formed by methods including mechanical processing, laser processing, or etching.

Moreover, the diamond deposition tip portions 23 are formed on the plurality of substrate tip portions 21 to the same thickness. As shown in FIGS. 2*a* through 3*b*, the diamond deposition tip portions 23 may be formed on all of the substrate tip portions 21, or only on some of the plurality of substrate tip portions 21. In exemplary embodiments, as shown in FIGS. 4*a* through 5*b*, the diamond deposition tip portion 23 is formed on one substrate tip portion 21, of the adjacent substrate tip portions 21, and is not formed on the other substrate tip portion 21.

As shown in FIGS. 5*a* and 5*b*, when the substrate tip portions 21 include substrate tip portions 21 having a rectangular cross-sectional shape, and substrate tip portions 21*a* having a triangular cross-sectional shape, both of which are alternated with each other, the diamond deposition tip portions 23 are formed on the substrate tip portions 21 having a rectangular cross-sectional shape.

Herein, the diamond deposition tip portions 23 may be formed on the substrate tip portions 21 using chemical vapor deposition (CVD). For example, before the substrate tip portions 21 are formed, a diamond deposition layer may be formed on one surface of the substrate 10 and planarized, followed by partially removing the diamond deposition layer while leaving the diamond deposition layer in the regions wherein the substrate tip portions 21 are to be formed.

Herein, chemical vapor deposition of the diamond deposition layer is performed under the following conditions: pressure: 10-55 Torr; flow rates of hydrogen and methane: 1-2 SLM, and about 25 SCCM, respectively; temperature of the substrate 10: about 900° C.; filament temperature: 1900-2000° C.; and distance between the substrate 10 and filaments: 10-15 mm.

The diamond deposition layer thus deposited is planarized to a thickness of 1-10 μm using a resin or ceramic polishing plate having 2000-mesh or larger particles in a planarization process in order to ensure the overall uniformity of the diamond deposition layer. Then, the diamond deposition tip portions 23 may be formed uniformly on the substrate tip portions 21 to a thickness of 1-10 μm.

Moreover, removal of the diamond deposition layer may be performed by etching (e.g., reactive ion etching, dry etching, wet etching, or plasma etching), mechanical processing, or laser processing.

After the diamond deposition layer has been removed, the upper surface of the cutting patterns 20 is dressed by etching or mechanical processing in order to eliminate the difference in height, the collapse of the corners, or curved cross-sectional portions. This dressing process can be performed using a wheel having a SiC abrasive material, or a resin wheel having diamond grits. Herein, the abrasive wheel or the resin wheel having diamond grits includes fine abrasive particles having a size of 2,000 mesh or larger in view of surface toughness or the stability of the cutting tips.

Figure 2A:
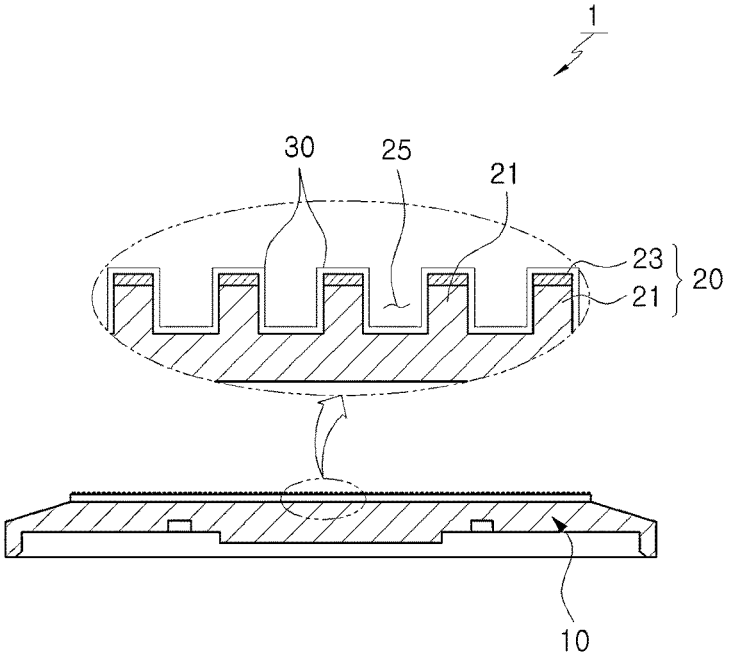
FIGS. 2*a* and 2*b* are cross-sectional views of a CMP pad conditioner according to one embodiment of the present invention.
Figure 2B:
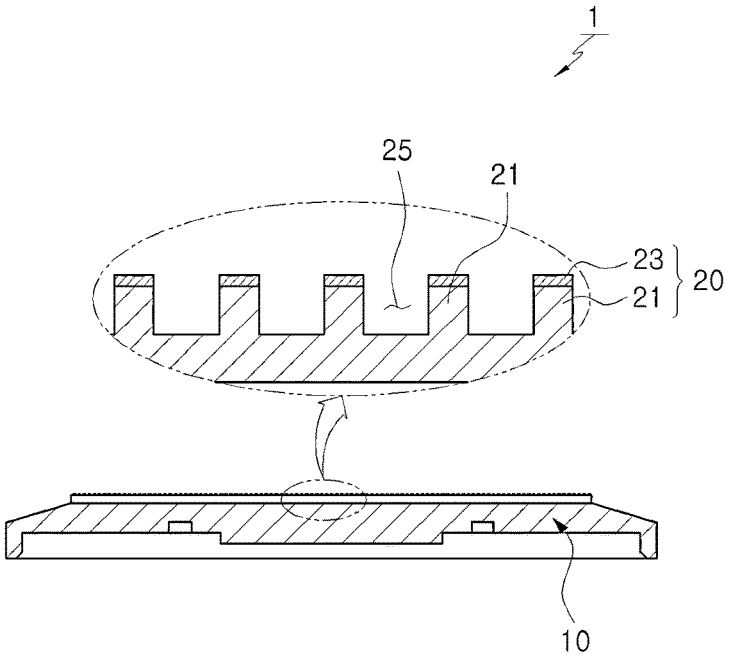
Figure 3A:
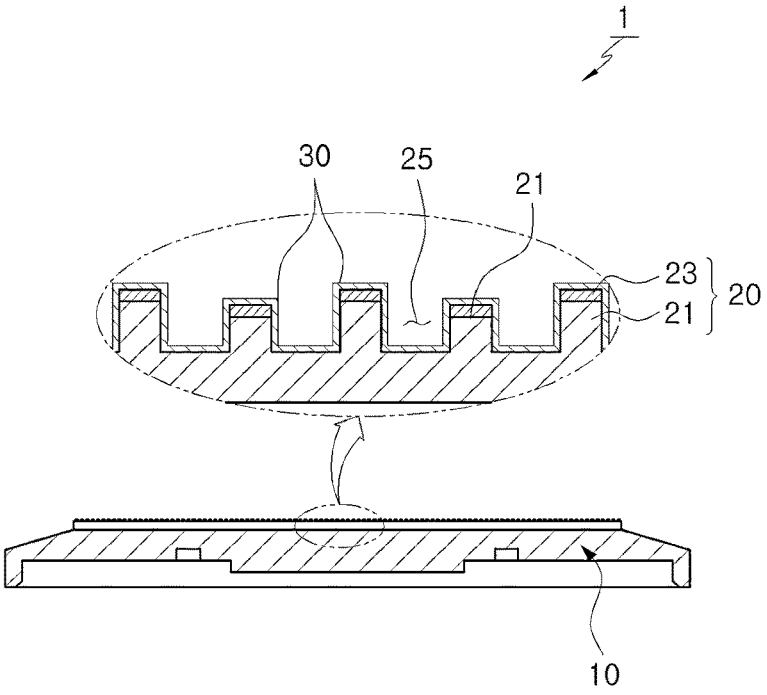
FIGS. 3*a* and 3*b* are cross-sectional views of a CMP pad conditioner according to another embodiment of the present invention.
Figure 3B:
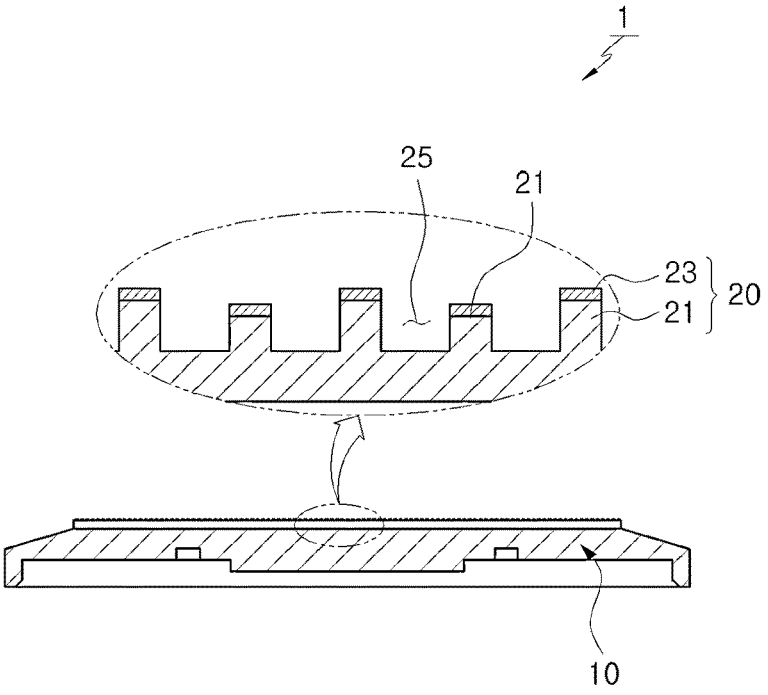
Figure 4A:
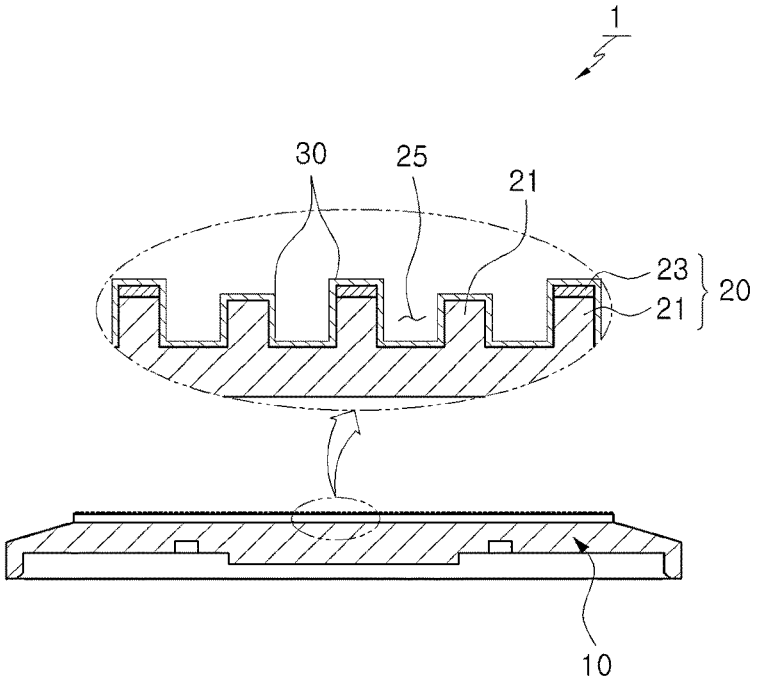
FIGS. 4*a* and 4*b* are cross-sectional views of a CMP pad conditioner according to still yet another embodiment of the present invention.
Figure 4B:
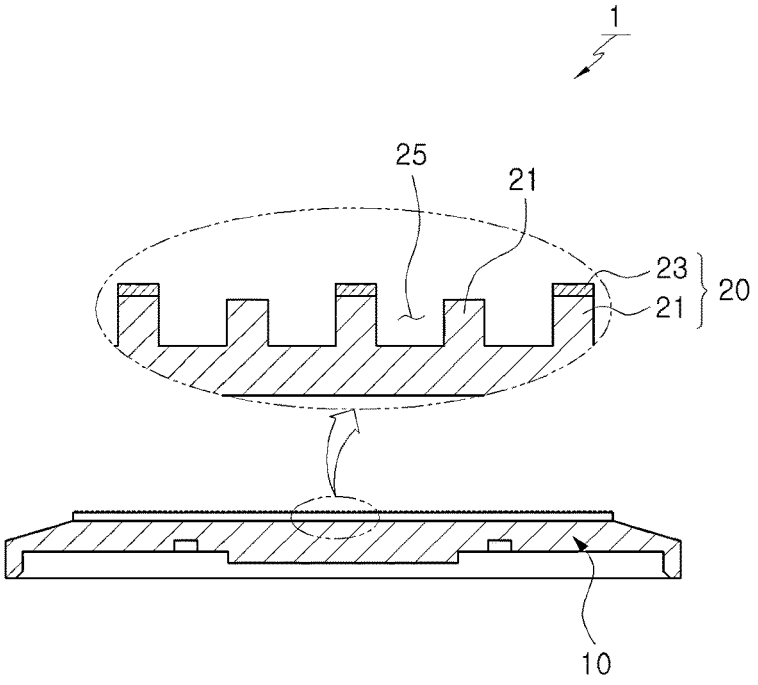
Figure 5A:
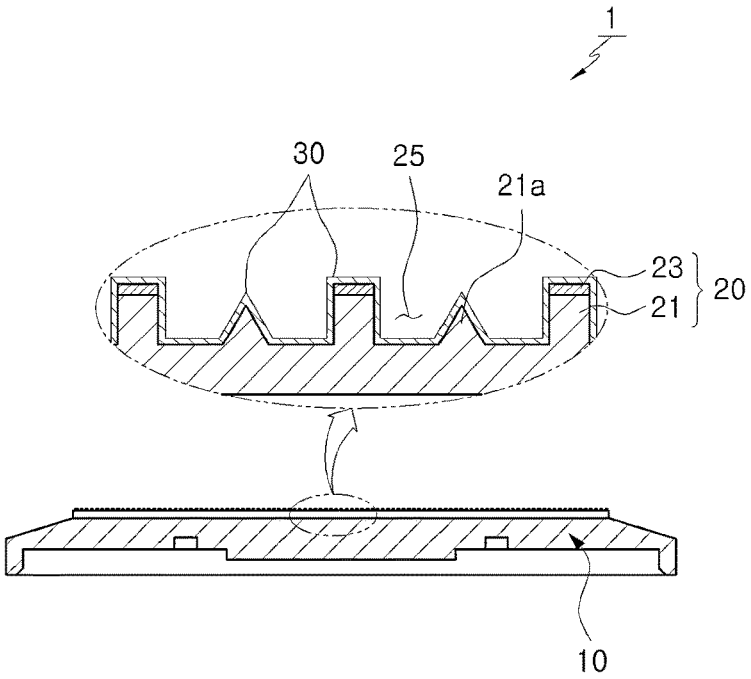
FIGS. 5*a* and 5*b* are cross-sectional views of a CMP pad conditioner according to yet another embodiment of the present invention.
Figure 5B:
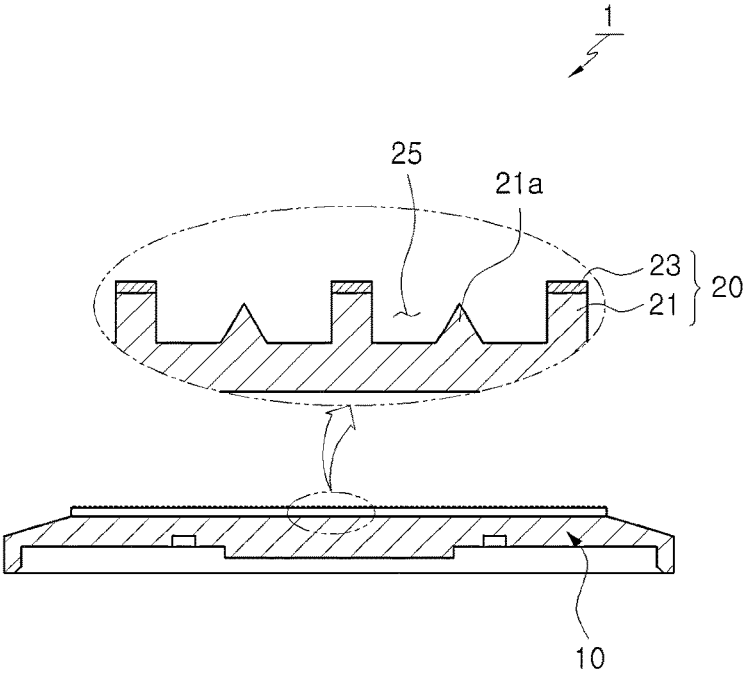

As shown in FIGS. 2*a*, 3*a*, 4*a*, and 5*a*, a diamond coating layer 30 may be formed on the substrate 10 and the cutting tip patterns 20, to a thickness thinner than that of the diamond deposition tip portions 23, using chemical vapor deposition. Before the diamond coating layer 30 is formed, the substrate 10 having the substrate tip portions 21 and the diamond deposition tip portions 23 formed thereon, is preferably subject to ultrasonic pretreatment. In this ultrasonic pretreatment process, fine scratches are formed on the deposition tip portions 23 and the remaining depressions 25 and substrate tip portions 21 using fine diamond particles in order to firm up the diamond coating layer. After the diamond coating layer 30 has been formed, the heights of the cutting tips of the cutting tip patterns 20 differ in an alternating pattern as shown in FIGS. 3*a*, 4*a*, and 5*a*.

As shown in FIGS. 2*b*, 3*b*, 4*b*, and 5*b*, the diamond coating layer 30 can be omitted in some cases (e.g., where the durability of the cutting tip patterns 20 is sufficiently ensured by the substrate tip portions 21 and the diamond tip portions, or in consideration of the conditions of use).

As described above, the CMP pad conditioner according to the present invention has a structure in which the diamond deposition tip portions 23 are formed on the substrate tip portions 21. Accordingly, the thickness of the diamond deposition tip portions 23 in the cutting tip patterns 20 may be very small, and thus the diamond that is deposited to form the diamond deposition tip portions 23 of the cutting tip patterns 20 may be deposited to a smaller thickness. Thus, even when the growth rate of diamond in the thermal filament process is as low as about 0.1-0.3 μm/hr, the deposition time of diamond for forming the diamond deposition tip portions 23 is significantly reduced, because a significant portion of the height (30-60 μm) of the cutting patterns 20 for use as the cutting tips of the conditioner 1 have the substrate tip portions 21. This can increase the productivity of the CMP pad conditioner 1.

In addition, according to the present invention, the cutting tip patterns 20 are formed of the substrate tip portions 21 and the diamond deposition tip portions 23, which are formed on the substrate 10. Thus, the strength, stability, and durability of the cutting tip patterns 20 having a fine structure are sufficiently ensured, unlike the conventional CMP pad conditioner wherein the cutting tip pattern 120 is formed of only the diamond layer. Accordingly, the breakage and detachment of the cutting tip pattern 20 in a conditioning process can be prevented, so that the problem of scratching wafers is solved.

The CMP pad conditioners according to the present invention, in particular the CMP pad conditioner 1 having the structure in which the cutting tip patterns 20 include cutting tips which are different in height, have the following excellent effects: pad polishing is performed by the higher cutting tip patterns 20; debris generated during the conditioning process is finely crushed by the lower cutting patterns; and sludge resulting from the polishing of wafers is efficiently discharged through the space provided by the difference in height between the cutting tip patterns 20.

The durability of the cutting tip patterns 20 of the CMP pad conditioner 1 according to the present invention was tested, and the results of the test are shown in Table 1 below and FIGS. 6 and 7.

In the durability test, sample 1 is a conventional CMP pad conditioner comprising cutting tip patterns formed of only diamond, and sample 2 is the inventive CMP pad conditioner wherein the cutting tip patterns, configured as shown in FIG. 2*a*, are composed of the substrate tip portions 21 and the diamond deposition tip portions 23.

Herein, sample 1 was obtained by depositing diamond on a 20 mm super-hard substrate to a thickness of 35 μm, forming cutting tip patterns (each 50 μm (L)×50 μm (W)) at intervals of 1 mm using a laser, ultrasonically washing and pretreating the resulting structure, and forming a 5 μm diamond coating layer on the patterns by a thermal filament process.

Sample 2 was obtained by forming, on a 20 mm super-hard substrate 10, 35 μm thick cutting tip patterns 20 composed of 5 μm thick diamond deposition tip portions 23 and substrate tip portions 21, ultrasonically washing and pretreating the resulting structure, and forming a 5 μm diamond coating layer on the resulting structure by a thermal filament process.

TABLE 1

| Shear height (μm) | Shear strength (g) | Sample 1, measured at 5 points | Sample 2, measured at 5 points |
|---|---|---|---|
| 0 | Average | 44.3 | 864.9 |
| 20 | Average | 43.5 | 724.4 |
| 25 | Average | 39.3 | 663.7 |
| 30 | Average | 35.4 | 617.2 |

Figure 6:
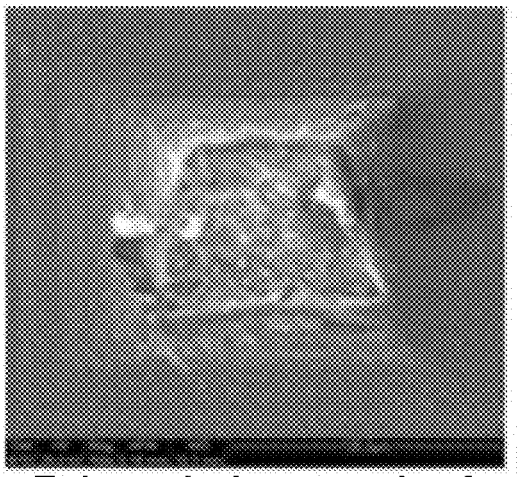
FIG. 6 is a photograph showing a durability test for the cutting tip pattern of the CMP pad conditioner of FIG. 1.
Figure 7:
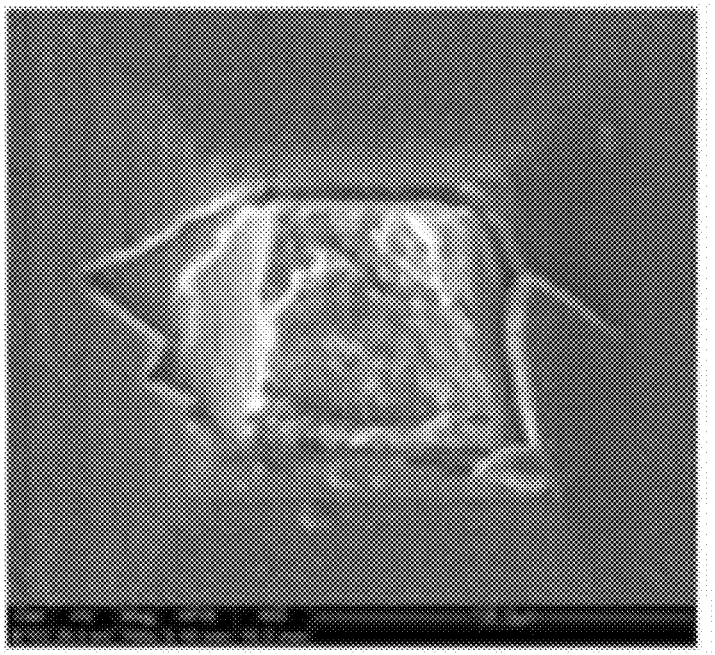
FIG. 7 is a photograph showing a durability test for the cutting tip pattern of a CMP pad conditioner according to the present invention.

As can be seen in Table 1 above, and FIGS. 6 and 7, sample 1 (i.e., the conventional CMP pad conditioner) exhibits an average shear strength of about 40 g, because it has low toughness against impact and load due to the inherent characteristics of diamond. In addition, as the shear height increases (i.e., goes toward the end of the cutting tip patterns), the shear strength decreases, suggesting that, as the height of the cutting tip patterns increases, the possibility of breakage or detachment at the end increases.

Conversely, it can be seen that the shear strength of sample 2 (i.e., CMP pad conditioner 1 according to the present invention) is at least 10 times higher than that of sample 1 (viz., conventional) thanks to the mechanical toughness of the substrate tip portions 21.

Thus, in the CMP pad conditioner 1 according to the present invention, the strength, stability, and durability of the cutting tip patterns 20 are sufficiently ensured.

As described above, the productivity of the CMP pad conditioner according to the present invention is increased, because the cutting tip patterns are formed in a fast and easy manner. Also, the cutting tip patterns formed may have a fine structure while the strength and stability thereof can be sufficiently ensured.

In addition, the CMP pad conditioner according to the present invention efficiently removes debris and expels foreign matter, such as sludge, during a conditioning process.

Although the embodiments of the present invention have been disclosed for illustrative purposes, those skilled in the art will appreciate that various modifications, additions, and substitutions are possible, without departing from the scope and spirit of the invention as disclosed in the accompanying claims.

The invention claimed is:

1. A chemical mechanical polishing (CMP) pad conditioner, comprising:

a substrate; and cutting tip patterns formed on at least one surface of the substrate, the cutting tip patterns comprised of:

a plurality of substrate tip portions integrally formed on a surface of the substrate by mechanical processing, laser processing, or etching the surface of the substrate, the plurality of substrate tip portions spaced apart from each other, the plurality of substrate tip portions comprising first substrate tip portions; and diamond deposition tip portions each formed uniformly and directly only on each of top surfaces of the first substrate tip portions.

2. The CMP pad conditioner of claim 1, wherein the plurality of substrate tip portions include the substrate tip portions having different heights.

3. The chemical mechanical polishing (CMP) pad conditioner of claim 1, further comprising:

second substrate tip portions on which the diamond deposition tip portions are not formed.

4. The CMP pad conditioner of claim 3, wherein the plurality of substrate tip portions are formed to have the same height; and the diamond deposition tip portions have the same thickness, are formed alternately on the substrate tip portions, whereby, when the diamond deposition tip portion is formed on one substrate tip portion, the diamond deposition tip portion is not formed on the substrate tip portions neighboring said one substrate tip portion on which the diamond deposition tip portion is formed.

5. The CMP pad conditioner of claim 3, wherein the substrate tip portions have a polygonal cross-sectional shape.

6. The CMP pad conditioner of claim 3, wherein the substrate tip portions have a polygonal, circular or elliptic planar shape.

7. The CMP pad conditioner of claim 3, wherein the diamond deposition tip portions have a thickness of 1 to 10 μm.

8. The CMP pad conditioner of claim 7, wherein an upper surface of the cutting tip patterns is dressed with a wheel comprising an SiC abrasive material or a resin wheel comprising diamond grits so that a difference in height, a collapse of corners, and curved cross-sectional portions on the cutting patterns are eliminated.

9. The CMP pad conditioner of claim 3, wherein the CMP pad conditioner further comprises a diamond coating layer formed on both the substrate and the cutting tip patterns.

10. The CMP pad conditioner of claim 3, wherein the cutting tip patterns have a fine structure of 100 μm or less.

11. The CMP pad conditioner of claim 1, wherein the substrate tip portions have a polygonal cross-sectional shape.

12. The CMP pad conditioner of claim 1, wherein the substrate tip portions have a polygonal, circular, or elliptic planar shape.

13. The CMP pad conditioner of claim 1, wherein the diamond deposition tip portions have a thickness of 1 to 10 μm.

14. The CMP pad conditioner of claim 13, wherein an upper surface of the cutting tip patterns is dressed with a wheel comprising a SiC abrasive material or a resin wheel comprising diamond grits.

15. The CMP pad conditioner of claim 1, wherein the CMP pad conditioner further comprises a diamond coating layer formed on both the substrate and the cutting tip patterns.

16. The CMP pad conditioner of claim 1, wherein the cutting tip patterns have a fine structure of 100 μm or less.

17. A chemical mechanical polishing (CMP) pad conditioner, comprising:

a substrate of which a surface has a plurality of protrusions and a plurality of depressions formed by mechanical processing, laser processing, or etching the surface of the substrate, the plurality of protrusions comprising a first substrate tip portions spaced apart from each other; and diamond films each formed uniformly and directly only on each of top surfaces of the first substrate tip portions.

18. A chemical mechanical polishing (CMP) pad conditioner, consisting of:

a substrate of which a surface has a plurality of protrusions and a plurality of depressions formed by mechanical processing, laser processing, or etching the surface of the substrate, the plurality of protrusions comprising a first plurality of substrate tip portions spaced apart from each other; and diamond films each formed uniformly and directly only on a top surface of the first plurality of substrate tip portions.

* * * * *